US005546112A

United States Patent [19]

Hunter et al.

[11] Patent Number: 5,546,112

[45] Date of Patent: Aug. 13, 1996

[54] EPM HAVING A SYSTEM FOR DETECTING FAULT CONDITIONS OF THE THERMAL PRINTHEAD

[75] Inventors: Kevin D. Hunter, Stratford; Arno Muller, Westport, both of Conn.

[73] Assignee: Pitney Bowes Inc., Stamford, Conn.

[21] Appl. No.: 331,259

[22] Filed: Oct. 28, 1994

[51] Int. Cl.[6] ..... B41J 2/35

[52] U.S. Cl. ..... 347/171

[58] Field of Search ..... 347/171; 400/120.01

[56] References Cited

U.S. PATENT DOCUMENTS

| | | | |
|---|---|---|---|
| 4,086,530 | 4/1978 | Coppola et al. | 324/133 |
| 4,453,166 | 6/1984 | Enoto | 346/1.1 |
| 4,595,935 | 6/1986 | Brooks et al. | 346/76 PH |
| 4,717,924 | 1/1988 | Bangs et al. | 346/76 PH |
| 4,813,802 | 3/1989 | Gilham et al. | 400/74 |
| 4,983,989 | 1/1991 | Komuro et al. | 346/1.1 |
| 5,183,343 | 2/1993 | Tazawa et al. | 400/103 |

*Primary Examiner*—Huan H. Tran

*Attorney, Agent, or Firm*—Charles G. Parks, Jr.; Melvin J. Scolnick

[57] ABSTRACT

In an electronic postage meter which has a thermal printer and a control system for causing the thermal printer to print a postage indicia, the thermal printer includes a linear array of thermal elements. The electronic postage meter control system is comprised of a print control circuit for producing lengthwise and serially, during a first mode of operation, a composite image having alphanumeric characters and graphic data. The image is divided into a plurality of widthwise sections. A first widthwise section has highly critical alphanumeric character information and graphic information. A second widthwise section of the image having less critical alphanumeric character information. The control system has a second mode of operation for producing serial test data coupled to the thermal elements such that the thermal print elements are selectively responsive to the serial test data for developing for each of the thermal elements an associated test signal during each second mode of operation. A comparison of each test signal for each of the thermal elements against an associated predetermined reference signal is performed in order to automatically generate an associated failure signal when a defective thermal element is detected during a second mode of operation. If, the failure is associated with first widthwise section and no failure are associated with the second widthwise section, than the image is shifted to avoid the failure, otherwise print is stopped. If the failure is associated with the second widthwise section and the failures are less that a predetermined number than the thermal printer continues to print, otherwise printing stop.

5 Claims, 4 Drawing Sheets

EPM HAVING A SYSTEM FOR DETECTING FAULT CONDITIONS OF THE THERMAL PRINTHEAD

BACKGROUND OF THE INVENTION

This invention relates to the thermal printing apparatus and, more particularly, to a thermal printing electronic postage meter for printing of a postage indicia, and a method for automatically detecting a fault condition in a thermal printhead and providing remedial action in response to the detection of the fault condition depending on the type and location of the fault condition.

Metering of mail is conventionally done in either a prepayment or a post payment mode. That is, in one system of postage payment, the owner of a postage meter prepays to the post office a certain amount of funds for which he receives credit within the vault, or sometimes referred to as accounting system, of the postage meter. In another system, known as a post payment system, the mailer is charged for postage expended from the use of his meter. In either system, it is critical that proper accounting be made for the value of postage dispensed by the meter and that accounting for expended postage can be reconciled between the post office and the mailer. The post office assures itself of proper posting by referring to the numeric value which is part of the printed postage indicia. The indicia is comprised of artwork which is intended to be of such a nature as to the very difficult to counterfeit, a posting value, a posting date, and a posting location. Additionally, there is a meter identification or validation number included as part of the postage indicia. Each part of the indicia represents an added degree of security in assuring that fraudulent posting has not taken place. For example, it is very critical that the value amount is printed accurately as it represents the funds being transferred between the customer and the post office. The posting date is very important, in that, there are rules that require that the posted mail be placed in the hands of the postal service on the date of posting. The meter identification number or validation number is a means of checking that the funds transfer are being made via a authorized postage meter.

The use of digital printing techniques, particularly thermal printers, has introduced printing fault conditions which are not present in convention impacted postage meter printing techniques. For example, should the thermal printhead have a defective element or elements, depending on the location of the element or elements, substantial alteration of the information being conveyed by the postage indicia can occur. For example, a defective thermal elements in the region which is printing the posting date can make a "9" appear to an optical reading device as a "0". Or a "2" appear as a "7", or a "6" appear as a "5". Therefore, in areas where numeral values are being printed, it is very critical that the printing control circuit knows or in some way detect the presence of a defective print element in these areas, and then perform the proper corrective measures. Other areas of the indicia are less critical, such as, in the area of the artwork where a defective or an operative print element will not affect the accounting for postage printing.

As a result, it is necessary or beneficial for the control system of a digital printing system associated with an electronic postage meter to be able to detect defective print elements as a fault condition relative to the location of that defective print element or elements in the indicia to be printed and then take corrective action in response to that condition. Conventional thermal control system provides means of detecting the presence of a bad thermal element, however, in the case of barcode printing the control system simply provides a shifting of the full bar code to avoid the defective element. It is appreciated that such systems are limited in the number of shifts which can practicably be performed. Other systems which address principally alphanumeric character printing systems merely prevent further printing once a bad element is detected.

Another defect condition is associated with the thermal printhead temperature during the printing process or at startup in which the environment is very cold. In either case, the transfer of printing ink from the thermal printhead ribbon to the print medium, for example, an envelope or tape strip can be adversely affected, thereby producing a partial or distorted image. Another fault condition occurs if the printhead is operated at excessive temperatures over a period of time resulting in premature failure of the printhead.

SUMMARY OF THE INVENTION

It is an object of the present invention to present a means of detecting the presence of a defective print element relative to a bit mapped indicia comprised of a fixed image and variable information and depending on the indicia area effected by the defective element, the control system will shift the bit mapped of the whole indicia, shift the location of the fixed information within the image, or will cause the micro control system to realize that it is in a critical area and cannot be moved, thereby causing the machine to shut down.

It is a further objective of the present invention to present a digital print control system for an electronic postage meter which has a fault tolerance capability depending upon the print region within the indicia bit map to which the fault has occurred.

It is a still further objective of the present invention to present a micro control system for an electronic postage meter having digital printing which incorporates decision logic which takes corrective action depending upon where the printhead fault element is relative to the printed indicia.

The present invention includes a control circuit for an electronic postage meter having a print control system having a test mode in which each of the print elements of the printhead are tested to find out if the respective element is in an operative condition or a fault condition. If a print element is in a fault condition, the micro control circuit then references that fault condition to the area of the indicia bit map and depending on where that fault lies relative to the indicia bit map takes appropriate corrective action. That corrective action can be: to shift the indicia such that, the defective element is avoided; determine that the defective element is in a non-critical area of the indicia and therefore do nothing; or, determine that the defective element is in a critical area and, if so, whether a limited data shift can or cannot be performed to avoid the defective element(s) and, if not, shutting the electronic postage meter. A fault tolerance is provided relative to the non-critical regions of the indicia such that the EPM will operate efficiently provided the number of defective elements in a non-critical area does not exceed a chosen reference value.

DETAILED DESCRIPTION OF THE PREFERRED EMBODIMENT

Figure 1:
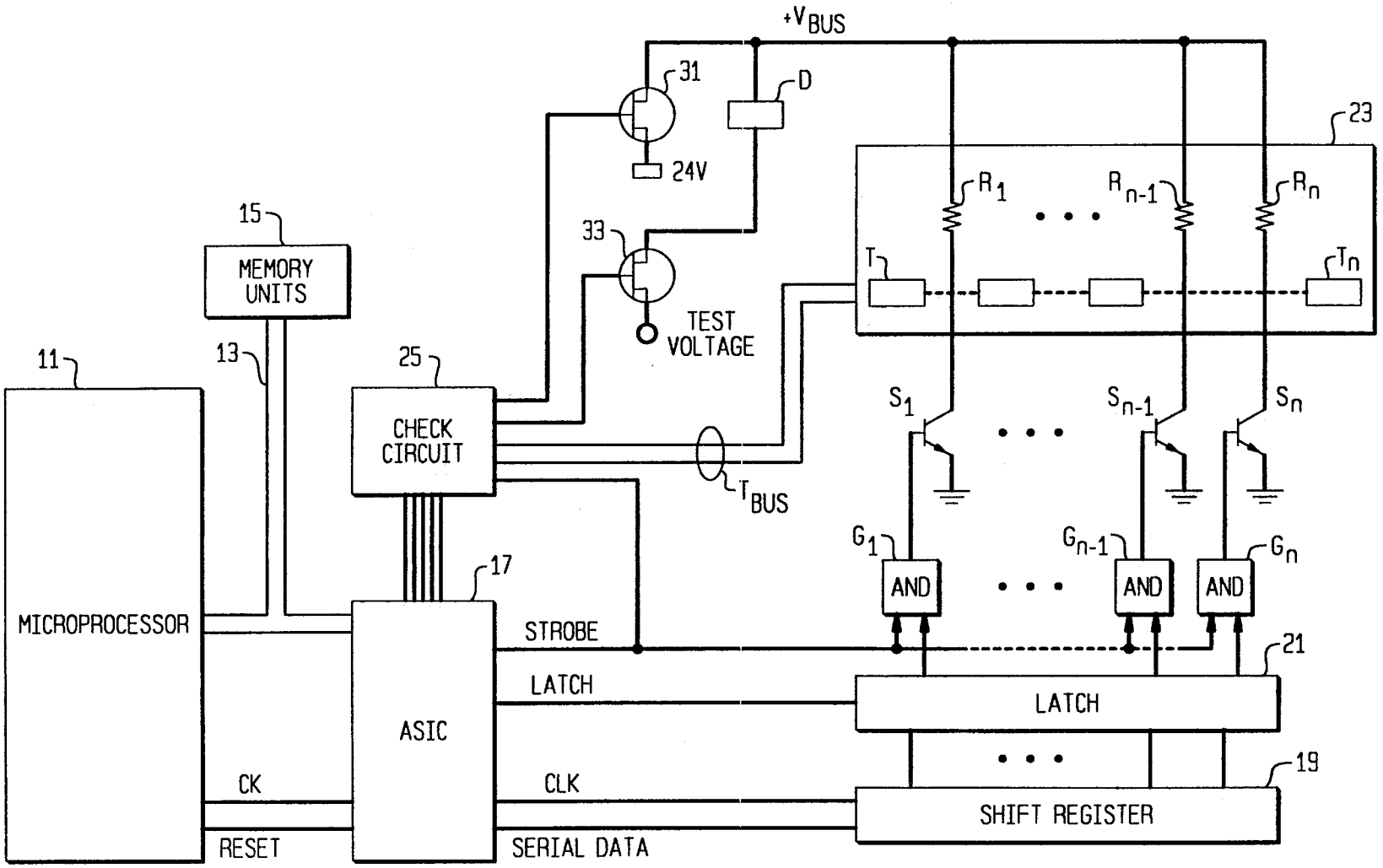
FIG. 1 is a schematic of a control circuit in accordance with the present invention.

Referring now to FIG. 1, the thermal printhead control system is comprised of a microprocessor 11 in bus 13 communication with an ASIC 17 and memory unit 15. The ASIC 17 is in communication with a shift register 19 for transferring serial data representative of the postage indicia. Also going to the shift register 19 from the ASIC 17 is a clock signal for clocking in data to the shift register 19. The shift register 19 is in communication with a latch 21 which latches in the signal to a series of AND gates, $G_1$–$G_n$. Each AND gate $G_1$–$G_n$ communicates with a respective gate $S_1$–$S_n$. Power is supplied to the thermal printhead 23 and is selectively gated through selected thermal resistors $R_1$–$R_n$ from the voltage bus $V_{bus}$. Printing voltage is provided and gated through a gate element 31 to the voltage bus or through a gate element 33 which provides a substantial reduced voltage for test purposes. Gates 33 and 31 are enabled in response to control signals from a check circuit 25 to either enable the voltage bus with a printing voltage by turning or gating 31 "ON" or a test voltage by gating gate 33 "ON". The thermal printhead 23 also includes a plurality of thermal coupling devices $T_1$–$T_n$ which are in communication with the check circuit 25 through the bus T.

Figure 3A:
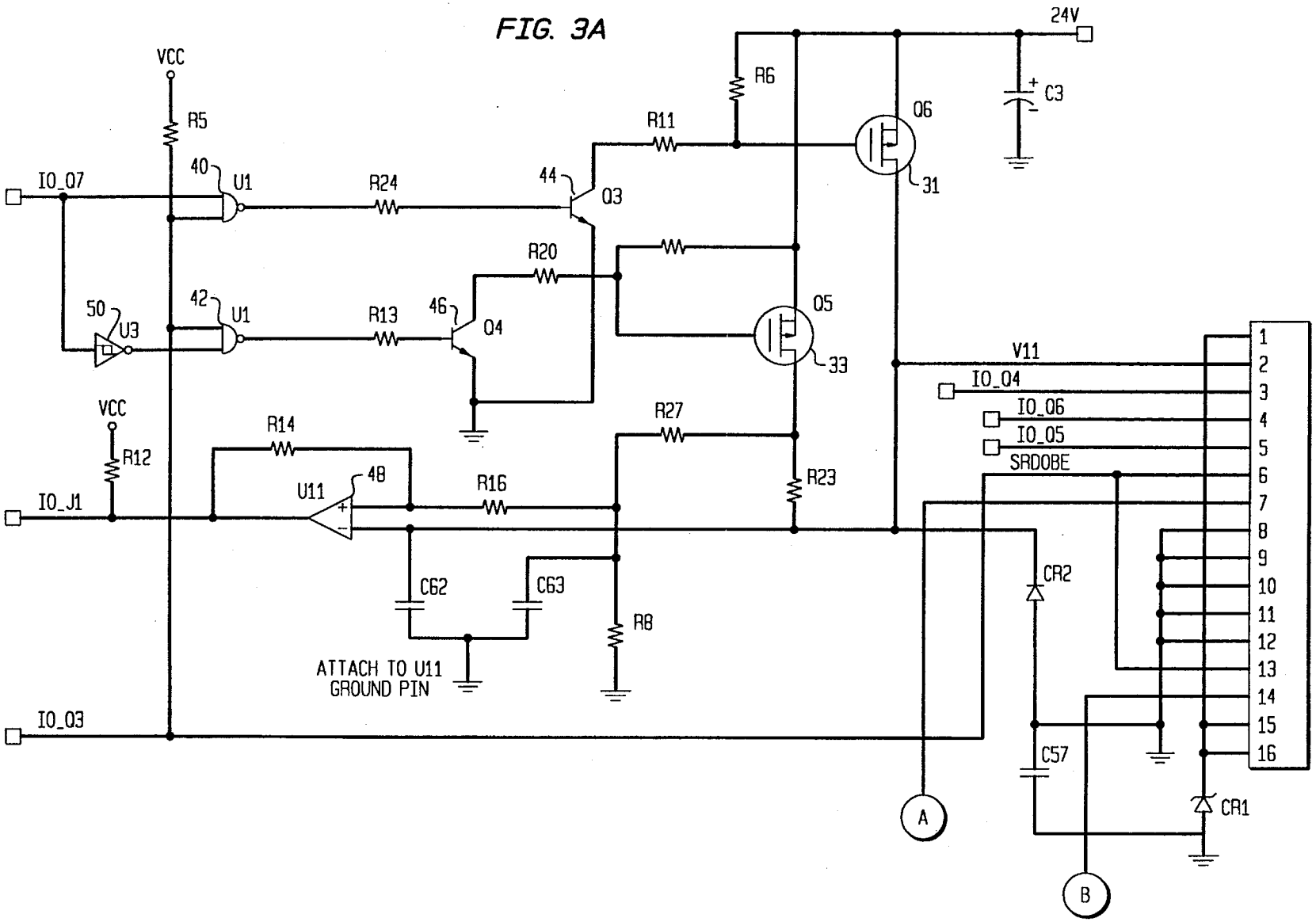
FIG. 3A is a schematic of a print element control portion of the check circuit for the control system in accordance with the present invention.
Figure 3B:
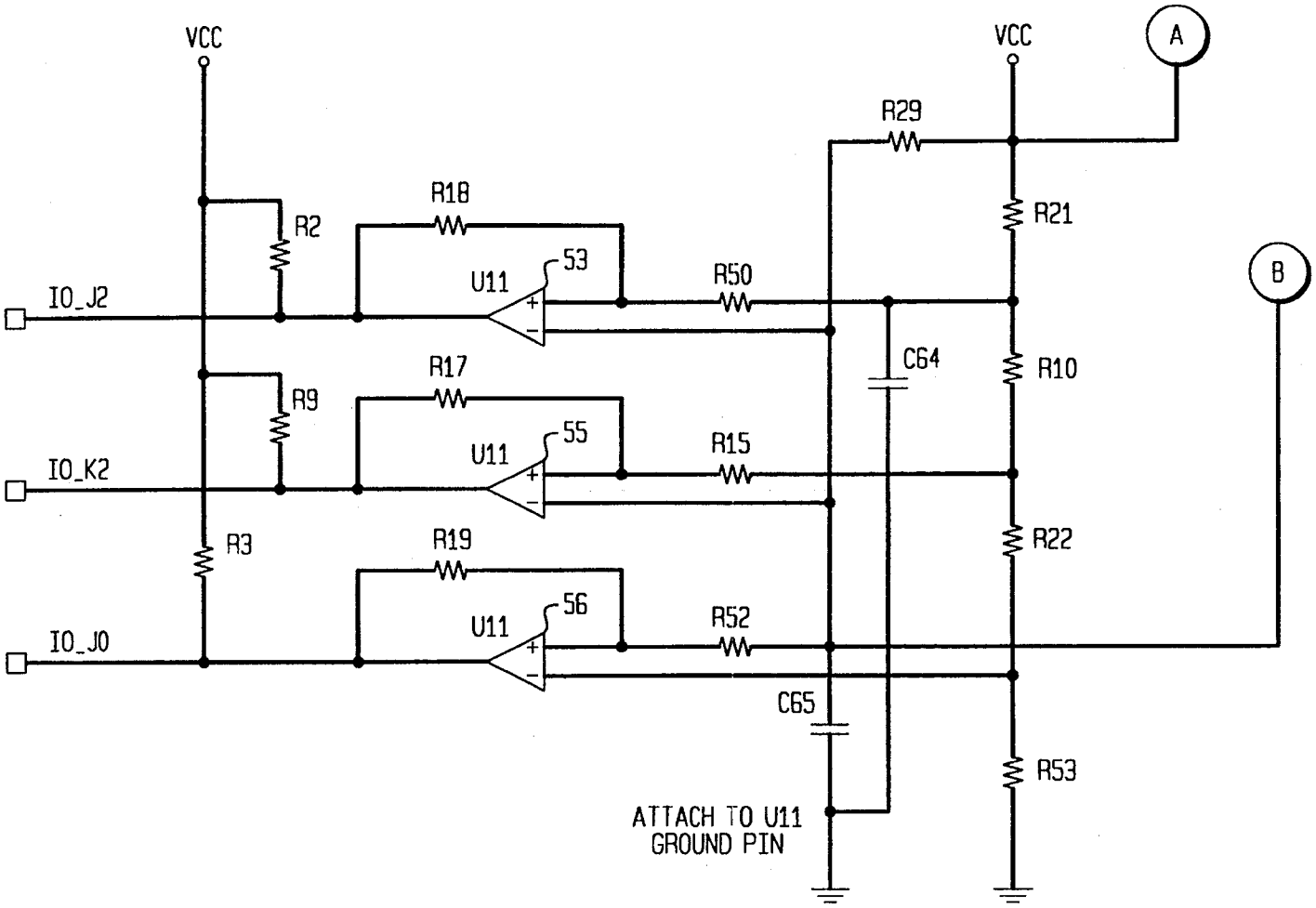
FIG. 3B is a schematic of a thermal check portion of the check circuit for the control system in accordance with the present invention.

Referring to FIGS. 3A and 3B, it is observed that the testing circuit 25 is comprised of a first stage which controls the supply of power to the thermal print elements $R_n$ and includes NORgates 40 and 42. Upon instruction from the microprocessor, the ASIC 17 issues a print control signal TPH directed to NORgate 40 and through an inverter 50 to NORgate 42. A strobe signal from the ASIC 17 is also directed to NORgates 40 and 42. When the control signal TPH goes active in combination with an active low strobe signal, NORgate 40 goes active. Concurrently, the NORgate 42, because of the presence of the inverter 50, is held inactive. The output from NORgate 40 switches transistor 44 "ON" which enables the power gate 31 to supply the enabling voltage to the thermal printhead through $V_{bus}$. Conversely, when the control signal TPH goes inactive, i.e., in a test mode, in combination with an active low strobe signal, NORgate 40 is held inactive and NORgate 42 goes active. The output from NORgate 42 then enables the gate 46, thereby gating the supply power through the power gate 33. The presence of R27 and R23 in line with the output of gate 33 provides a voltage divide to reduce the voltage level to the printhead 23.

In operation, during a print mode the microprocessor 11 addresses the ASIC 17 to initiate a print cycle subsequent to the specification of posting amount by the operator or other means. The ASIC 17 then assesses the memory units for data transfer from the memory unit of the fixed image portion of the indicia to a buffer and merged data of the font bit map for the alphanumeric portion of the indicia. The data is then directed to the shift register 19. A more detailed description of the data retrieval is set forth in U.S. patent application Ser. No. 08/271,317, entitled "Control System For An Electronic Postage Meter Having A Programmable Printhead Controller", filed Jul. 6, 1994, herein incorporated by reference and commonly assigned. As the data is serial directed to the shift register 19 and latch 21 latches in the data. The output from the latch 21 is presented to the respective AND gates $G_1$ to $G_n$. When the strobe signal goes active the respective AND gates $G_1$ to $G_n$ are enabled. In response to the enabling of the respective AND gates $G_1$ to $G_n$, the respective thermal elements $R_1$ to $R_n$ are enabled to receive a voltage from the voltage bus $V_{bus}$ which is supplied with printing voltage by enabling of gate 31. As a result, the enabled thermal elements $R_1$ to $R_n$ develop sufficient heat energy for printing. As an envelope is transported pass the thermal print head, the respective thermal elements are enabled and, in this manner, thermal ink is caused to be deposited on the envelope to form an indicia image.

During a non printing mode of a postage meter, the print enable signal TPH goes inactive which then enables the NOR gate 42 as above described, resulting in a test voltage being placed on the $V_{bus}$. Serial data is then sequentially sent to the shift register and latched. In this manner each thermal element $R_1$ through $R_n$ can be individually tested. Concurrently, with having the test voltage supplied to the respective thermal element $R_n$, the voltage drop across the respective thermal element $R_n$ is compared to a reference voltage by the comparator 48. If the voltage drop is insufficient, then the comparator 48 goes active thereby providing a signal to the ASIC 17 that the respective element $R_n$ being tested is bad.

Figure 2:
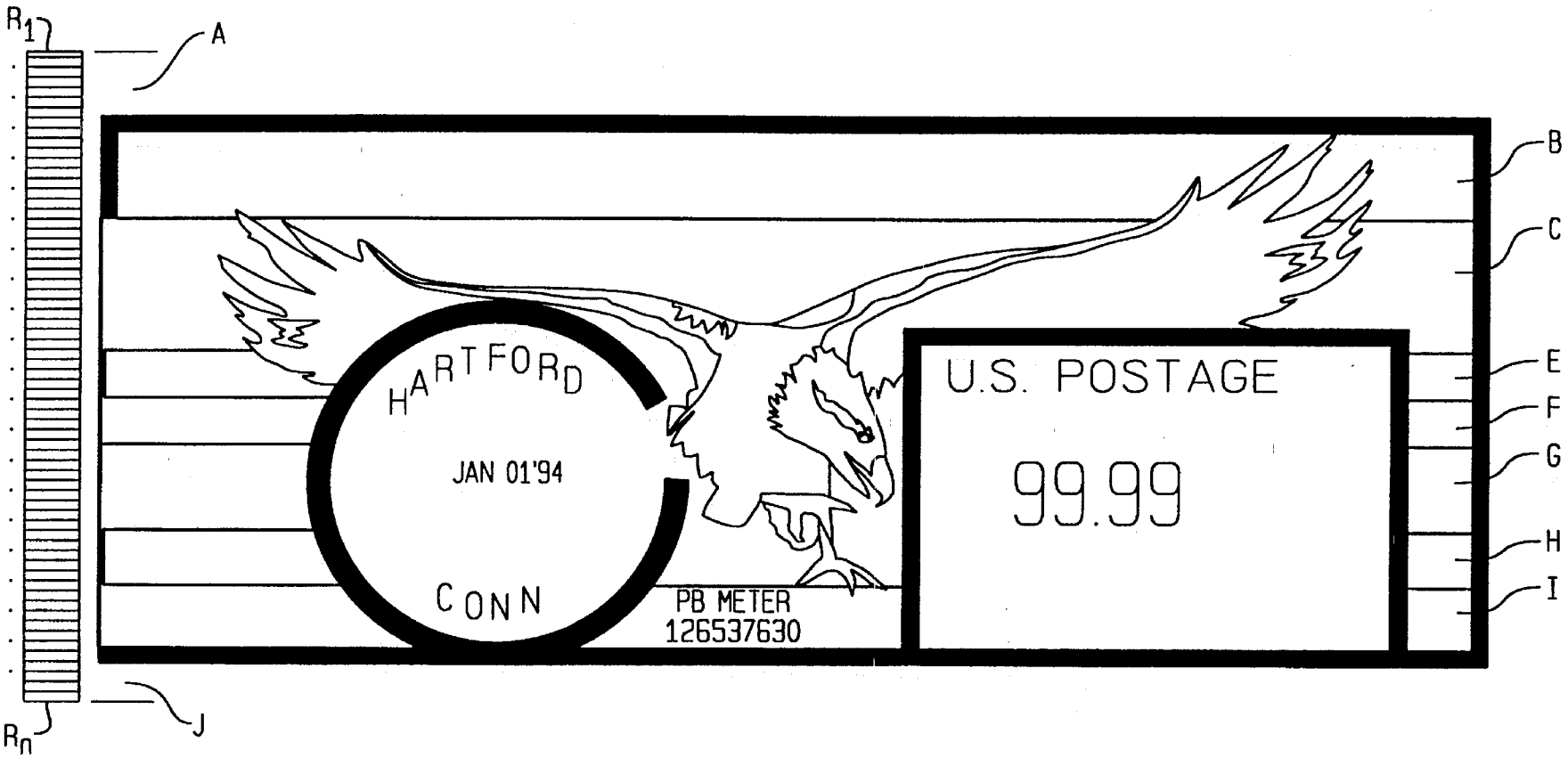
FIG. 2 is a illustration of a postage indicia noting the indicia regions in accordance with the present invention.

Referring also to FIG. 2, the postage indicia 60 is longitudinally section as shown in table 1 relative to the print element of the print head 23.

TABLE 1

| | |
|---|---|
| Region's A, B, C | - Assign Priority Level 3 |
| Region E | - Assign Priority Level 2 |
| Region F | - Assign Priority Level 3 |
| Region G | - Assign Priority Level 1 |
| Region H | - Assign Priority Level 3 |
| Region I | - Assign Priority Level 1 |
| Region J | - Assign Priority Level 3 |

It can be observed that the Regions E, which includes the alpha character for the posting city, is given a higher priority and that Regions G and I are given the highest priority and contain such information as posting amount, posting date and meter verification number. In the test mode, once a defective element has been detected, the microprocessor 11 is programmed to printhead state and respond accordingly as indicated in table 2.

TABLE 2

STATE TABLE

CASE 1

If defective print element in region B
and Σ Bn<Kb then continue
If ΣBn>Ka then Shift Image Jn elements;
Set Flag F1, then continue
If Flag F1 is previously set, then stop

CASE 2

If defective print element in region J
and Σ Jn<Kj then continue
If ΣJn>$K_b$, then Shift Image An elements;
Set F2; Then continue
If Flag F1 is previously set, then stop

CASE 3

If defective print element in region C, F or H
and ΣCn<Kc, ΣFn<Kf, and ΣHn<Kh; then set Flag F3
and continue TABLE 2-continued

| STATE TABLE |
|---|
| If ΣCn>Kc, ΣFn>Kf, or ΣHn>Kh then stop |
| CASE 4 |
| If defective print element in region E, G, I and Flag F1, F2 and F3 are not set then shift Image Bj elements then continue |
| If Flags F2 is set but not Flags F1 and F3 the shift Image An elements then continue |
| If Flag F3 is set then stop |

Referring to table 2, in state cases 1, if a bad print element is located in region B and the total number of bad elements in that region exceed a preselected number then the entire bit mapped is shifted by the microprocessor to avoid the elements of that region and a flag $F_1$ is set. In like manner, in case 2, if a bad element is detected in region J and the total number of bad element in the region exceeds a second preselected number and flag $F_1$ is not set, then a image shift is performed and a flag $F_2$ is set. If flag $F_1$ has been set the printing processes is stop.

In case 3, if a defective element is determined to inhabit region C, F or H and the number of defective elements in the respective regions is lest than a preselected number, then set flag $F_3$ and continue. However if the number of defective in a given region then stop. In case 4 if a defective print element in found in regions E, G, or I and none of the flags are set then the image is shifted, preferably shifted down to incorporate the J region. If flag $F_2$ is set but not $F_1$ and $F_3$ then the image is shifted upward to incorporate the A region. However if flag $F_3$ is set then the process is stop because any shift would shift the high priority information into a region with known excessive defective elements.

It should now be appreciated that the system as provides a means of determining the presents of a defective element relative to the region of the indicia image to provide some fault tolerance, except where such fault tolerance would adversely effect the region of the postage indicia presenting critical information.

Referring to FIG. 3B, the check circuit also includes a circuit for assessing the temperature of the print head 23. The print head 23 includes a number of thermal couplers $T_n$. The output from the respective thermal couplers are presented to comparators 53, 55 and 56. If the temperature is high indicating a very heated condition, then by comparing to a reference voltage, then the comparator 53 goes active informing the micro control system of that condition. If the comparator 55 goes actives, then the microprocessor is informed that the circuit is at medium temperature. And if all three comparators 53–56, then the microprocessor is informed that the temperature is too hot and then the system can be shut down.

The following represents the preferred embodiment of the present invention and should not be viewed as limiting.

What is claimed is:

1. In an electronic postage meter having a thermal printer and a control system for causing the thermal printer to print a postage indicia, said thermal printer including a linear array of thermal elements, said electronic postage meter control system comprising:

means for producing lengthwise and serially, during a first mode of operation, a composite image comprised of alphanumeric characters and graphic data, said image being divided into a plurality of widthwise sections, at least a first of said widthwise sections of said image having highly critical alphanumeric character information, and at least a second of said widthwise sections of said image having less critical alphanumeric character information, and for producing during a second mode of operation serial test data;

means coupled to said thermal elements being selectively responsive to said serial test data for developing for each of said thermal elements an associated test signal during each second mode of operation;

means for selectively comparing each test signal for each of said thermal elements against an associated predetermined reference signal in order to automatically generate an associated failure signal when a defective thermal element is detected during a second mode of operation; and, means responsive to a failure signal associated with said defective thermal element and for relating said failure signal to said first or second widthwise sections if, said failure signal is associated with the first of said widthwise sections and no failure are associated with said second widthwise section, for causing said image to be shifted to avoid said failure signal, otherwise stop, if said failure signals is associated with the second of said widthwise sections and said failure signals are less that a predetermined number for causing said thermal printer to continue to print, otherwise stop.

2. In an electronic postage meter having a thermal printer and a control system for causing the thermal printer to print a postage indicia, said thermal printer including a linear array of thermal elements, said electronic postage meter control system comprising:

means for producing lengthwise and serially, during a first mode of operation, a composite image comprised of alphanumeric characters and graphic data, said image being divided into a plurality of widthwise sections, at least a first of said widthwise sections of said image having highly critical alphanumeric character information, at least a second of said widthwise sections of said image having less critical alphanumeric character information, and at least a third of said widthwise sections of said image having only graphical information, and for producing during a second mode of operation serial test data;

means coupled to said thermal elements being selectively responsive to said serial test data for developing for each of said thermal elements an associated test signal during each second mode of operation;

means for selectively comparing each test signal for each of said thermal elements against an associated predetermined reference signal in order to automatically generate an associated failure signal when a defective thermal element is detected during a second mode of operation; and, means responsive to a failure signal associated with said defective thermal element and for relating said failure signal to said first or second widthwise sections if, said failure signal is associated with the first of said widthwise sections and no failure are associated with said second widthwise section, for causing said image to be shifted to avoid said failure signal, otherwise stop, if said failure signal is associated with the second of said widthwise sections and said failure signals are less that a predetermined number $K_1$ for causing said thermal printer to continue to print, otherwise stop, if said failure signal is associated with the third of said widthwise sections and said failure signals are less that a predetermined number $K_2$ which is greater than $K_1$ for causing said thermal printer to continue to print, otherwise stop.

3. An electronic postage meter as claimed in claim 2, further comprising:

means for determine a fault condition wherein the temperature of said thermal printer and prevent operation of said thermal print head unless said temperature is between $T_1$ and $T_3$.

4. An electronic postage meter as claimed in claim 3 further comprising means of determining if said thermal printer temperature is above or below a temperature $T_2$.

5. In an electronic postage meter having a thermal printer and a control system for causing the thermal printer to print a postage indicia, said thermal printer including a linear array of thermal elements, said electronic postage meter control system comprising:

means for producing lengthwise and serially, during a first mode of operation, a composite image comprised of alphanumeric characters and graphic data, said image being divided into a plurality of widthwise sections, at least a first of said widthwise sections (E, I, G) of said image having highly critical alphanumeric character information, at least a second of said widthwise sections (C, F, H) of said image having only graphical information, at least a upper boarder of said widthwise sections (B) having only graphical information, and at least a lower boarder of said widthwise sections (J) having no initial data assigned thereto, and and for producing during a second mode of operation serial test data;

means coupled to said thermal elements being selectively responsive to said serial test data for developing for each of said thermal elements an associated test signal during each second mode of operation;

means for selectively comparing each test signal for each of said thermal elements against an associated predetermined reference signal in order to automatically generate an associated failure signal when a defective thermal element is detected during a second mode of operation; and, means responsive to a failure signal associated with said defective thermal elements and for relating said failure signal to said respective widthwise sections If defective print element in the upper boarder of said widthwise sections and the total number of defective thermal elements is less than $K_b$ then continue, the total number of defective thermal elements is greater than $K_a$ then shift image $J_n$ thermal elements and set flag F1, then continue, If flag F1 is previously set, then stop, If defective element in region J and the total number of defective thermal elements is less than Kj then continue If the total number of defective thermal elements is greater than $K_b$ then shift image an thermal elements and set F2 then continue, If flag F1 is previously set, then stop, If defective thermal element in region C, F or H and total number of defective thermal elements is less than Kc, total number of defective thermal elements is less than<Kf, and total number of defective thermal elements is less than<Kh; then set Flag F3 and ΣCn<Kc, ΣFn<Kf, and ΣHn<Kh; then set Flag F3 and continue, If ΣCn>Kc, ΣFn>Kf, or ΣHn>Kh then stop, If defective thermal element in region E, G, I and flag F1, F2 and F3 are not set then shift image Bj elements then continue, If flags F2 is set but not flags F1 and F3 the shift image an thermal elements then continue, if flag F3 is set then stop.

* * * * *